United States Patent [19]

Credali et al.

[11] Patent Number: 4,710,336

[45] Date of Patent: Dec. 1, 1987

[54] PROCESS FOR PREPARING TWO-COMPONENT SYNTHETIC FIBERS SUITED FOR REPLACING CELLULOSE FIBERS

[75] Inventors: Lino Credali, Casalecchio di Reno; Gianfranco Corsi; Antonio Chiolle, both of Ferrara, all of Italy

[73] Assignee: Montedison S.p.A., Milan, Italy

[21] Appl. No.: 798,400

[22] Filed: Nov. 15, 1985

Related U.S. Application Data

[63] Continuation of Ser. No. 692,421, Jan. 18, 1985, abandoned, which is a continuation of Ser. No. 488,816, Apr. 26, 1983, abandoned.

[30] Foreign Application Priority Data

Apr. 27, 1982 [IT] Italy ..... 20951 A/82

[51] Int. Cl.[4] ..... D01D 1/02; D01D 5/11

[52] U.S. Cl. ..... 264/171; 264/205; 264/211.14; 264/DIG. 26; 264/DIG. 29

[58] Field of Search ..... 264/DIG. 26, 171, DIG. 29, 264/122, 205, 349, 176 R, 206, 211.14; 524/41, 503, 515, 522, 523, 524

[56] References Cited

U.S. PATENT DOCUMENTS

| | | | |
|---|---|---|---|
| 3,548,028 | 12/1970 | Itabashi et al. | 264/DIG. 26 |
| 3,750,383 | 8/1973 | Vakizawa | 368/242 |
| 3,770,856 | 11/1973 | Ueki et al. | 523/218 |
| 3,808,091 | 4/1974 | Aoki et al. | 264/13 |
| 3,876,454 | 4/1975 | Snell et al. | 525/477 |
| 3,915,920 | 10/1975 | Slovinsky et al. | 524/522 |
| 3,975,463 | 8/1976 | Hirata et al. | 264/176 R |
| 4,002,796 | 1/1977 | Baldi et al. | 525/61 |
| 4,111,737 | 9/1978 | Wesley | 156/458 |
| 4,211,737 | 7/1980 | Di Drusco et al. | 264/14 |

FOREIGN PATENT DOCUMENTS

| | | |
|---|---|---|
| 0891943 | 2/1962 | United Kingdom . |
| 1262531 | 2/1972 | United Kingdom . |
| 1355912 | 6/1974 | United Kingdom . |
| 1392667 | 4/1975 | United Kingdom . |
| 1430796 | 4/1976 | United Kingdom . |
| 1446034 | 8/1976 | United Kingdom . |

*Primary Examiner*—Jan H. Silbaugh
*Assistant Examiner*—Hubert C. Lorin
*Attorney, Agent, or Firm*—Stevens, Davis, Miller & Mosher

[57] ABSTRACT

Two-component fibers, having surface area of at least 1 $m^2/g$, suited for replacing cellulose fibers in the manufacture of paper and paper-like products comprise a core of olefinic polymer and from 2 to 50% by weight of a sheath of a hydrophilic polymer, and exhibit values of the tenacity higher than 3,000 meters and cohesion higher than 300 meters. They are prepared by extruding a stable emulsion formed by a mixture of a solution of the olefinic polymer with a solution of the hydrophilic polymer in reciprocally immiscible solvents, at a temperature exceeding the boiling temperature of the solvent of the olefinic polymer and at least equal to the dissolution temperature of such polymer in such solvent, in a medium at a lower pressure, by using a volume ratio of solvent for the olefinic polymer to solvent for the hydrophilic polymer of at least 2.5 and concentrations of hydrophilic polymer in its solution of at least 2 g/l of solvent.

3 Claims, No Drawings

PROCESS FOR PREPARING TWO-COMPONENT SYNTHETIC FIBERS SUITED FOR REPLACING CELLULOSE FIBERS

This is a continuation, of application Ser. No. 692,421, filed Jan. 18, 1985, now abandoned which in turn is a continuation of Ser. No. 488,816 filed Apr. 26, 1983 now abandoned.

THE PRIOR ART

Several attempts were already made in the past aiming at obtaining, from the synthetic polymers, fibrous material suitable for replacing the cellulosic material in the various applicances thereof. To this end, there were prepared and/or used fibers, also of the composite type (two-component fibers), prepared according to the conventional spinning methods, as well as fibers having a morphology similar to the one of the cellulose fibers, endowed with a great surface area (fibrils) obtained from polymer solutions, emulsions or suspensions by spinning or extrusion under instantaneous evaporation conditions (flash-spinning) of the liquid phases present therein. Processes and fibres of such type are described, for example, in British Pat. Nos. 891,943; 1,355,912 and 1,262,531; in U.S. Pat. Nos. 3,770,856; 3,750,383; 3,808,091; 4,111,737, in French Pat. Nos. 2,173,160 and 2,176,858, and in German patent application No. 2,343,543.

However, none of the type of synthetic fibers proposed till now has proved suited to be utilized for preparing manufactured articles endowed with mechanical characteristics similar to the ones of the cellulose-based articles, nor does it exhibit the processability characteritics typical of the cellulose fibers. Generally, improvements in the characteristics of the manufacture articles prepared from such fibers are obtained by employing the latter in admixture with cellulose fibers, or by adding to them cohesion-imparting materials (acrylic latexes, urea-formaldehyde resins, etc.), which, however, exhibit the drawback of irreversibly binding the fibers with one another by means of "covalent" bonds and of providing non-regenerable products of little satisfactory general characteristics.

THE PRESENT INVENTION

We have now surprisingly found that two-component fibers with a great surface area, of the sheath-core type, i.e. comprising an inner core consisting of an olefinic polymer, and an outer sheath consisting of a suited amount of hydrophilic polymer, exhibit a general behaviour analogous with that of the cellulose fibers and are capable of providing, when paper-making methods are used, sheets or manufactured articles endowed with exceptional characteristics of cohesion and mechanical strength. Such fibers exhibit a surface area of at least 1 $m^2/g$ and, depending on the operative modalities followed for preparing them, may be in the form of individual or unitary fibers (fibrils) having a length generally ranging from 0.5 to 15 mm, or in the form of filaments or structures of different length consisting of aggregates of such individual fibers. Each individual, or unitary fiber comprises at least 2% by weight and in general from 2% to 50% by weight of a hydrophilic polymer referred to the sum of the weights of such polymer with the olefinic polymer. Preferably, the amount of hydrophilic polymer ranges from 4% to 35% by weight calculated on the above-mentioned weight sum.

Such fibers or fibrils show values of the tenacity, measured as specified in the following, higher than 3,000 meters, and preferably higher than 5,000 meters.

Such fibrous material, consisting of the abovesaid two-component fibrils, or of the aggregates of such fibrils, is prepared by subjecting to extrusion, through an orifice, a mixture in the form of a stable and homogeneous emulsion, consisting of the solutions of the olefinic polymer and of the hydrophilic polymer in the respective solvents which are at least partially immiscible with each other in the extrusion conditions, at a temperature exceeding the boiling temperature of the solvent of the olefinic polymer and at least equal to the dissolution temperature of the polyolefin in such solvent, and under an autogenous or a higher pressure, in a medium at a lower pressure, wherefore an almost instantaneous evaporation of the liquid phases takes place, and by collecting the fibrous material so obtained.

In the above said emulsions there is used a volume ratio of the solvent of the olefinic polymer to the solvent of the hydrophilic polymer of at least 2.5, and more preferably of at least 2.7. Generally, but not indispensably, said volume ratio is comprised between 2.5 and 15, and preferably between 2.7 and 10. In said emulsion, the concentration of the hydrophilic polymer in its own solution has to be of at least 2 g/liter of solvent.

Said volume ratio value of at least 2.5 appears to be indispensable for obtaining a stable emulsion of the "water-in-oil" type in the extrusion conditions, and for the manufacture of fibers having the above stated characteristics of tenacity and cohesion.

Actually it has been found that on operating by values of such volume ratio lower than 2.5, an emulsion of the "oil-in-water" is obtained which is quite unstable in the extrusion conditions, however high the amount of hydrophilic polymer in its own solution may be. The fibers obtained by operating at values of such volume ratio lower than 2.5 show low values of the tenacity (generally comprised between 1,000 and 3,000 meters, with an average value lower than 1,500 meters), combined with low values of the cohesion, and further not uniform and not reproducible morphology, and poor quality as regards the capability of giving rise to paper sheets devoid of translucent points.

Thus, an object of the present invention is that of providing two-component fibers endowed with a surface area of at least 1 $m^2/g$, comprising a core, or inner portion consisting of an olefinic polymer and an outer sheath, or coating, consisting of a hydrophilic polymer, this latter being in an amount comprised between 2% and 50% by weight on the weight of olefinic and hydrophilic polymers, said fibers having a value of the tenacity higher than 3,000 meters.

A further object of this invention resides in a process for preparing such fibers, which comprises the step of extruding through an orifice or a nozzle, in a medium at a lower pressure, a mixture, in the form of a stable emulsion, composed by the solution of an olefinic polymer and by the solution of a hydrophilic polymer as specified in the following, in at least partially reciprocally insoluble solvents, at a temperature higher than the boiling temperature of the solvent of the olefinic polymer, under normal conditions, and at least equal to the dissolution temperature of the olefinic polymer in such solvent, and under an autogenous pressure or a higher pressure, in which emulsion the volume ratio of the solvent for the olefinic polymer and the solvent for the hydrophilic polymer is of at least 2.5, and the solution of hydrophilic polymer contains at least 2 g of said hydrophilic polymer per liter of solvent.

As olefinic polymers there are generally employed high-density and low-density polyethylene, polypropylene, polybutene-1, polymethyl-4-pentene-1, ethylene-propylene copolymers and the ethylene-vinylacetate copolymers having a prevailing ethylene content. The term "hydrophilic polymers", whenever used herein means the polymers capable of forming, with water, hydrogen bonds, and substantially containing in their macromolecule, chain sequences of the polyester type $$(-\underset{\underset{O}{\|}}{C}-O-),\ \text{of the type}\ -(\underset{\underset{O}{\|}}{C}-NH_2),$$

or hydroxyl, nitrile, carboxylic, etheral, sulphonic, etc. groups.

Generally such polymers prove to be capable of absorbing at least 0.1% by weight of water, referred to their own weight, under relative humidity conditions of 100%, at a temperature of 20° C. Generally, all the hydrophilic polymers suited for preparing fibers or fiber-like materials can be used for preparing the fibers of the present invention; hydrophylic polymers having a molecular weight in the range of from 10,000 to 360,000 are generally preferred.

Examples of useful hydrophilic polymers are: polyacrylonitrile, polyamides, both aliphatic and aromatic, polyurethanes, polyethers, poly(alkyl)acrylates, polyester resins, vinyl polymers such as polyvinyl alcohol and polyvinyl acetate, polybenzoimidazoles, polyamido-hydrazides, polyamido-imides, copolyamides, polysulphones, polyphenylenesulphides, polycarbonates, the soluble starches, hydroxymethylcellulose, carboxymethylcellulose, etc.

The polyvinylalcohol can be used in the form of hydrolized polyvinylacetate with a hydrolysis degree of from 75 to 99%, and polymerization degree comprised between 350 and 2,500. Polyvinylalcohols which have been at least in part acetalized with aliphatic aldehydes, possibly also carboxylated, such as are disclosed in French patent application Nos. 2,223,442 and 2,257,635 are also utilizable.

The olefinic polymer solvent and the hydrophilic polymer solvent to be used for preparing the above said emulsion must be at least partially insoluble with each other in the extrusion conditions or in any case must form two separate, reciprocally emulsifiable phases, at the extrusion temperature and pressure, so that the solutions of the respective polymers, once mixed with each other, may provide an emulsion which is stable and of the "water-in-oil" type under the extrusion conditions, and not a single solution or liquid phase. Generally, the above said solvents should be soluble with each other at the extrusion conditions in an amount not higher than 2% by weight. Furthermore, the solvent of the olefinic polymer shall not be such for the hydrophilic polymer, and vice versa.

The concentration of the olefinic polymer in its own solution is comprised between 20 and 200 g/l, but preferably between 50 and 100 g/l of solvent. The concentration of the hydrophylic polymer in its own solution is comprised between 2 and 300 g/l of solvent.

Fibers containing different amounts of outer sheath of hydrophylic polymer as high as, or in excess of 2% by weight can thus be obtained, by varying the concentration of hydrophylic polymer in its solution and/or the volume ratio of the solvent for the olefinic polymer to the solvent for the hydrophylic polymer, provided that values of said concentration and volume ratio of at least 2 g/l and at least 2.5, respectively, are maintained.

The fibers prepared according to the process of the present invention show values of the self-cohesion generally higher than 300 meters, and preferably higher than 600 meters.

The emulsion to be extruded is preparable according to any known method. For example, it is possible to separately introduce into an autoclave the solution of the hydrophylic polymer and a mixture of the olefinic polymer with its own solvent, bringing then the temperature of the mixture in the autoclave to the value of the one selected for the extrusion, under stirring, wherefore dissolution of the olefinic polymer in its own solvent and formation of a homogeneous emulsion from the two polymeric solutions take place. Otherwise it is possible to introduce into an autoclave, either separately or already mixed with each other, the two polymers with their respective solvents and then to select the above said dissolution, emulsifying and extrusion conditions.

According to another method, the two polymeric solutions are caused to meet inside the extrusion nozzle by mixing them with each other in the form of an emulsion prior to the extrusion. As solvents for the olefinic polymer there may be cited, as an example, the hydrocarbon solvents of the aliphatic and the aromatic type, and in particular those belonging to class P (poorly hydrogen bonded) according to the classification by H. Burrel and B. Immergut, in Polymer Handbook, IV, page 341 (1968), examples thereof being ethylene, propylene, ethane, propane, butane, n-pentane, n-hexane, n-heptane, toluene, xylene, nitromethane, methylene chloride, etc.

As solvents for the hydrophylic polymer there may be cited, as an example, the solvents belonging to class M (moderately hydrogen bonded), examples thereof being the esters, ethers, and ketones, as well as the solvents belonging to class S (strongly hydrogen bonded) such as the organic and inorganic acids, the amides, the amines, the alcohols, in which such polymers are soluble also at room temperature.

Examples of preferred solvents of class M are: dimethylformamide, dimethylsulphone, N-methyl-pyrrolidone, dimethylacetamide, and mixtures thereof. Preferred solvents of class S are: methanol, pyrrolidone, methylformamide, piperidine, tetramethylene glycol, formamide, water, and mixtures thereof. Salts of inorganic and/or organic acids of metals of groups IA and IIA, e.g. LiCl, $LiNO_3$, $Mg(ClO_4)_2$, NaCl, $NaNO_3$, $Na_2SO_4$ may be present in admixture with such solvents, since they are favorably affect the dissolving power towards the olefinic polymer and the fibers surface area values.

Surfactants of the ionic or non-ionic type may be present in the emulsions to be extruded, preferably in amounts not higher than 1% by weight on the whole weight of the olefinic and hydrophylic polymers. The presence of these surfactants generally enhances the surface area of the fibers.

For the preparation of the fibers by the process of the present invention, the geometry of the nozzle through which the polymeric emulsion is extruded is not determinant.

Optionally, for obtaining two-component individual fibers (fibrils), or substantially non-aggregate fibers, it can be operated by directing against the product leaving the extrusion orifice or nozzle a fluid jet in the form of gas or vapor at high speed, having a parallel and angular direction in respect of the extrusion direction of the polymeric emulsion, and in particular at angles of from 0° to 150° in respect of such direction. Such gas or vapor shall have, at the time of the impact with the extruded product, a temperature not higher, and preferably lower than the temperature at which the polymeric emulsion is extruded. The speed of such gas or vapor, at the time of such impact, may vary from a few tones of meters per second for example 40 m/sec., up to multiples of the sound velocity. In particular, as a fluid it is possible to use steam, or the vapor of one of the solvents utilized to prepare the extruded emulsion; or a gas, such as nitrogen, carbon dioxide, oxygen, and in general all the fluids which are cited in British Pat. No. 1,392,667 in the name of Montedison S.p.A., relating to the preparation of polyolefinic fibrils, accomplished by extruding solutions of such polymers under solvent flash conditions, by using such cutting fluids.

According to such variant, two-component individual, discontinuous fibers, instead of aggregate fibers, are obtained which have a morphology more similar to the one of the cellulose fibers, especially as regards the length, which may range in such case from about 0.5 to about 10 mm, and the average diameter, which may range from 1 micron to 50 microns.

A particularly suitable device for practising the process of the present invention with the use of cutting fluids, as described hereinbefore, consists of a nozzle of the convergent—divergent type, advantageously a nozzle "de Laval", through which such fluid is made to flow in the direction of the longitudinal axis, while the polymeric emulsion is extruded through orifices located in the divergent portion of such nozzle. Such device and process are described in U.S. Pat. No. 4,211,737.

The fibers forming the object of the present invention are characterized by the capability of being processed by refining as common cellulose fibers, with an increase in the freeness degree (°SR), in the cohesion and tenacity.

The unusual behavior of such fibers to refining may be assumed to be attributable to the structural change they undergo during such treatment in the aqueous medium, the structure changing from that of an aggregate of individual fibers (held reciprocally together through the single coatings penetrated by hydrophylic polymer) which is present in a certain amount in the extrusion product, to that of individual fibers whereinto such aggregate decomposes to the cost of the refiner energy, with phenomena of reduction in length, diameter and flotation degree of said fibers, of increase in their freeness degree, and in their capability of cohesion in wet and in dry conditions, as well as of improvement of their paper properties (smoothness degree, tear strength and bursting strength of the sheets).

The fibers according to the invention exhibit also a high capability of entrapping inert materials such as mineral fillers in powder (kaolin, talc, kieselguhr, micas, $TiO_2$, glass and asbestos fibers, etc.), and furthermore of being dyed with and types of dyes (direct dyes, vat dyes, reactive dyes and pigments) and, finally, of being superficially treated with reagents with a view to changing at will the surface characteristics (Z potential, exchange power, etc.) and the characteristics of cohesion with other types of fibers, however without modifying the surface area values and the mechanical characteristics thereof.

The increase in the freeness degree (°SR) and simultaneously in the cohesion values ($LR_5$) as a consequence of refining represents one peculiar characteristic of the fibers according to the present invention containing at least 4% by weight of hydrophylic polymer as outer sheath.

In fact it has been found that such fibers, when subjected to refining in a Lorentz-Wettres hollander, type 3-1, having a rated capacity of 30 liters and an applicated load of 4.5 kg, in an amount of 690 g of fibers in 23 liters of water, at 30° C., exhibit, after a 5-hour refining, a freeness degree (°SR) increment of at least 100% and at the same time a cohesion degree ($LR_5$) increase of at least 50%.

Such behavior does not occur in the synthetic fibrous products commercially available or described in literature so far.

The fibers according to the present invention can be used either alone or in admixture with other fibrous materials (for example textile fibers, either natural or man-made, leather fibers; glass, asbestos, wood, cellulose, carbon, boron, metal, etc. fibers), optionally after treatment with wetting agents, as described f.i. in U.S. Pat. No. 4,002,796, and also, if desired, combined with other binders, for preparing manufactured articles of various nature, such as non-woven fabrics, paperboards, also of the corrugated type, thermo-moldable panels, felts, wall papers, bill papers, cover papers, packing papers, filters and filtering masses in general, insulating panels, asbestos lumber roofings and panels, containers for foodstuffs, filter bags and containers for coffee and tea, surgical instruments, decorative papers, barrier paperboards and papers, abrasive papers; and such as binders, both as such and after heat-treatment.

The following examples are given to illustrate the object of the present invention, without being however a limitation thereof.

Examples 30–32 illustrates a few appliances of the fibres according to the invention.

EXAMPLES 1–12

In an autoclave there were prepared, in 12 consecutive tests, No. 12 emulsions by cold mixing, under stirring, a solution of 50 g of high-density polyethylene (M.I.=5–7) in 1,000 cc of n-hexane, respectively with 100 cc of each of the hydrophilic polymer solution from 1 to 12, having the compositions indicated in Table 1. Each emulsion was brought to 150° C. and extruded, under the autogenous pressure, through 8 cylindrical nozzles, in the divergent portion of a de Laval nozzle, having a critical circular section of 6.5 mm diameter, and a maximum end section, in the divergent portion of the nozzle, of 15.42 mm diameter, the distance between critical section and maximum section being equal to 31.8 mm.

Such de Laval nozzle was passed through by water vapor having, at the inlet of the convergent portion, a pressure of 18 kg/m$^2$ gauge and a temperature of 205° C. The emulsion extrusion nozzles, symmetrically arranged around the end section of the de Laval nozzle, had a diameter of 1.5 mm. The polymeric emulsion was extruded through such extrusion nozzles at a total rate of 250 kg/h.

The fibrous product so obtained, substantially consisting of individual fibrils, was collected in a stripper fed from the bottom with steam, in order to remove the solvents, than it was washed with water and dried. The obtained fibers, after washing, resulted to be formed by a polyolefin core and by a coating of the hydrophylic polymer. Such a coating turned out to be extractable from the fiber, after 24 hours treatment in water at 100° C., in amounts not higher than 0.01% by weight on the weight of the coating before said treatment.

Some of the characteristics of the fibres obtained are reported in Table 2. Such characteristics were evaluated according to the following methods:

average (weighted) length: TAPPI-T 233 method, making use of a Lorentz-Wettres classifier and employing, as a standard, average values obtained with statistical method by direct reading on the optical microscope;

diameter: by direct reading on the optical microscope at 500 magnifications, as an average value;

surface area: by nitrogen absorption by means of apparatus "Sorptometro Perkin Elmer" according to the BET method;

tenacity (LRo, in meters) and cohesion ($LR_5$, in meters): on specimens measuring 3×10 cm, cut from sheets having a weight equal to 70 g/m$^2$, exclusively consisting of fibrils, prepared according to a paper-making method in the sheet mold-drier and conditioned during 24 hours at a temperature of 23° C. in a room at a relative humidity of 50%. Such specimens were subjected to tensile stress on Inston dynamometer at a deformation rate of 10% min. (traverse rate=0.5 cm/min). The tensile strength (CRo) determined with a span between the clamps equal to zero, and the tensile strength ($CR_5$) determined with a span of 5 cm were assumed as the measure of the tenacity and the interfibrillar cohesion of the fibers, respectively, and expressed as elongation at break LR (LRo and $LR_5$, respectively) in meters, according to the formula:

$$LR = \frac{CR \times 10^5}{G \times L}$$

wherein:

CR=tensile strength of Kg

G=sheet weight in g/m$^2$

L=specimen length in cm.

The reported determination is derived from standards TAPPI T 231 on 70;

bursting strength (RSM, in kg/cm$^2$): on circular test-pieces of 5 cm diameter, cut from sheets prepared as described hereinbefore, but having a weight equal to 80 g/m$^2$, using a Mullen apparatus;

tear strength (RL, in m$^2$): according to standard TAPPI T-414, on 100 g/m$^2$ sheets having dimensions of 76×63 mm on the Elmendorf apparatus;

freeness degree (°SR): according to method SCAN C19 MC 201/74, by operating at 20° C. on 2 g of fibers dispersed in 1 l of water, by means of the Schopper-Riegel beaten stuff tester produced by Lorentz-Wettres;

elementarizability index (I.E.): evaluated as cloudiness of sheets at 100% of fibrils, having a weight equal to 160 g/m$^2$, by comparison with cellulose paper sheets at a different refining grade, to which values from 1 to 10 had been assigned;

flotation index (I.F.): by dispersing 2 g of fibrils in 400 cc of water in a Waring mixer at the maximum speed, for 5 seconds, by siccessively introducing the fibrous suspensions into a graduated 500-cc cylinder, which was turned upside down for consecutively four times on a horizontal plane, and then by measuring the volume (Vi) of limpid water which was obtained underneath the fibers after 10, 20, 30, 40, 50, 60, 80 and 120 seconds. The results are expressed as flotation index (I.F.) according to the ratio: I.F.=Vi/4.

Table 3 shows the data relating to the behavior to refining of some of the obtained types of fibrils in respect of the behavior of the cellulosic fibers. Such refining was carried out in a laboratory hollander, type 3-1 manufactured by Lorentz-Wettres, having a rated capacity of 30 liters, with an applied load of 4.5 kg, at an average temperature of 30° C., using about 690 g of fibrils being tested, dispersed in 23 liters of water.

In Table 4 there are recorded the values of the cohesion degree of fibril mixtures prepared according to example 8 with conifer cellulose, in the form of sheets having a weight equal to 160 g/m$^2$, prepared from mechanical mixtures of the two types of fibers, out of which the cellulosic fibers had been pre-refined during 10 minutes, while the two-component fibers being tested had been pre-refined during 2 hours, in a hollander, under the same conditions as described hereinabove.

double folds: number of cycles at break on FRANK 840/I apparatus at a frequency of 110 cycles/min., in test pieces measuring 15×100 mm, at 23° C. and at 50% of relative humidity.

TABLE 1

| Test No. | Hydrophylic Polymer | Solvent | Concentr. % b.w. of the hydrophylic polymer in its own solution |
|---|---|---|---|
| 1 | polyacrylonitrile* | N,N—dimethylformamide | 10 |
| 2 | 5-polyvinylpyrrolidone** | water | 15 |
| 3 | acrylonitrile/styrene copolymer (30/70) (Novodur W of Bayer) | methyl-ethylketone | 15 |
| 4 | vinylchloride/vinylacetate copolymer (85/15) (SICRON of Montedison) | methyl-ethylketone | 20 |
| 5 | polyarylsulphone (condensation product of phenylolpropane with 4,4'-dichlorophenylsulphone) (ASTREL 360 of 3M) | N—methylpyrrolidone | 17 |
| 6 | polyvinylacetate (hydrolysis grade 75%, and molecular weight = 22,500) | methanol | 30 |
| 7 | polyvinylacetate (hydrolysis grade 88% and molecular weight = 100,000) | water | 10 |
| 8 | polyvinylacetate (hydrolysis grade 98% and molecular weight = 101,000) | water | 5 |
| 9 | linear starch (ASTROX 100 of Penich and Ford Ltd.) | water | 3 |
| 10 | polycarbonate (SINVET 271 of ANIC) | methylene chloride | 10 |
| 11 | carboxymethylcellulose (CMC-7M of Hercules) | water | 4 |
| 12 | cellulose acetate (with 52–54% of acetyl groups, of Eastman Kodak) | acetone | 15 |

TABLE 2

| Test No. | length (mm) | diameter (μm) | surface area ($m^2/g$) | LRo (m) | $LP_5$ (m) | RSM ($kg/cm^2$) | $RL_2$ (m) | -SR (°) | I.E. | I.F. ($cm^3$) | hydrophilic polymer in fiber % by weight |
|---|---|---|---|---|---|---|---|---|---|---|---|
| 1 | 2–8 | 5–30 | 8–16 | 7,000 | 990 | 4.2 | 120 | 16–28 | 7–9 | 5–15 | 16.0 |
| 2 | 2–4 | 5–10 | 6–14 | 3,200 | 1,000 | 3.7 | 130 | 14–28 | 6–8 | 5–15 | 10.0 |
| 3 | 6–9 | 15–30 | 8–12 | 3,400 | 1,000 | 1.8 | 150 | 14–18 | 4–6 | 40–80 | 25 |
| 4 | 4–8 | 10–20 | 3–6 | 3,300 | 1,100 | 4.3 | 150 | 16–24 | 5–7 | 20–40 | 28.6 |
| 5 | 4–7 | 5–15 | 4–10 | 6,000 | 1,500 | 7.3 | 270 | 18–30 | 6–8 | 5–20 | 25.4 |
| 6 | 2–7 | 5–15 | 4–6 | 5,000 | 3,000 | 5.7 | 170 | 16–30 | 4–6 | 10–60 | 37.5 |
| 7 | 1–10 | 1–40 | 4–6 | 7,000 | 5,000 | 7.9 | 150–250 | 20–50 | 7–9 | 0–30 | 12.0 |
| 8 | 1–10 | 1–40 | 4–8 | 6,000 | 3,700 | 6.8 | 130–210 | 20–40 | 7–9 | 0–60 | 8.0 |
| 9 | 1–10 | 1–40 | 4–12 | 4,000 | 700 | 5.10 | 150–300 | 18–36 | 5–8 | 0–100 | 5.0 |
| 10 | 2–6 | 5–20 | 5–10 | 4,000 | 1,250 | 3.5 | 100–200 | 14–20 | 5–7 | 20–60 | 16.6 |
| 11 | 3–5 | 10–15 | 6–8 | 3,500 | 1,000 | 5.3 | 150 | 14–20 | 5–6 | 20–50 | 6.4 |
| 12 | 2–4 | 5–12 | 8–10 | 4,000 | 1,500 | 6.0 | 180 | 16–22 | 4–6 | 20–50 | 23 |

TABLE 3

| Refining time (hours) | Fibrils of Example No. 1 | | | Fibrils of Example No. 8 | | | Conifer cellulose | | |
|---|---|---|---|---|---|---|---|---|---|
| | average length (mm) | cohesion (m) | °SR | average length (mm) | cohesion (m) | °SR | average length (mm) | cohesion (m) | °SR |
| 0 | 7.5 | 990 | 16 | 8.8 | 3,700 | 22 | 4.0 | 670 | 11 |
| 1 | 7.1 | 3,120 | 23 | 6.3 | 4,900 | 33 | 3.9 | 3,500 | 18 |
| 2 | 6.6 | 4,200 | 27 | 5.7 | 5,100 | 37 | 3.7 | 4,000 | 20 |
| 3 | 5.6 | 4,465 | 31 | 5.1 | 5,700 | 39 | 3.5 | 4,480 | 22 |
| 4 | 4.6 | 4,550 | 34 | 4.7 | 6,100 | 43 | 3.3 | 5,210 | 32 |
| 5 | 3.4 | 4,780 | 37 | 3.1 | 6,500 | 45 | 3.0 | 5,800 | 45 |

TABLE 4

Mechanical properties of sheets from mixtures of conifer cellulose with the fibrils prepared according to example No. 8.

| Content of two-component fibrils in the sheet | Cohesion (m) | Bursting strength ($Kg/cm^2$) | Tearing factor ($m^2$) |
|---|---|---|---|
| 0 | 1,970 | 1.08 | 76 |
| 10 | 2,430 | 1.23 | 86 |
| 25 | 2,630 | 1.61 | 101 |
| 50 | 2,830 | 2.03 | 133 |
| 75 | 2,510 | 2.27 | 177 |
| 100 | 3,290 | 3.53 | 202 |

grade) dissolved in water was used as hydrophilic polymer solution. The emulsion was prepared as described in Examples 1–12 and was extruded at the temperature of 135° C. under the autogenous pressure, through the same 8 cylindrical nozzles and in the same de Laval nozzle as described in the above said examples, with the difference that the vapor pressure was 8±2 $Kg/cm^2$.

In Table 5 there are reported the volume ratio of n.hexane to water and the concentration of polyvinylaclohol in water at which it was operated, and the characteristics of the fibers thus obtained.

TABLE 5

| | Examples | | | | | | | | | | | | | |
|---|---|---|---|---|---|---|---|---|---|---|---|---|---|---|
| | 13 | 14 | 15 | 16 | 17 | 18 | 19 | 20 | 21 | 22 | 23 | 24 | 25 | 26 |
| Volume ratio n. hexane/water | 2.5 | 2.7 | 2.7 | 2.8 | 2.8 | 2.9 | 2.9 | 2.9 | 2.5 | 2.4 | 2.1 | 1.7 | 1.1 | 0.5 |
| Polyvinylalcohol in water (g/1000 cc.) | 2.5 | 13.4 | 11.2 | 19.7 | 13.4 | 12.6 | 11.7 | 4.9 | 19.7 | 4.5 | 4.5 | 27.1 | 27.1 | 19.6 |
| Characteristics of the fibers | | | | | | | | | | | | | | |
| Average length (mm) | 3.1 | 2.64 | 2.34 | 2.80 | 2.80 | 2.05 | 2.37 | 1.75 | 2.11 | 1.44 | 1.68 | 1.76 | 1.83 | 1.96 |
| Diameter (micron) | 8–10 | 5–20 | 7–10 | 6–15 | 6–15 | 4–10 | 5–10 | 3–8 | 4–10 | 5–7 | 4–9 | 5–8 | 7–10 | 5–9 |
| Surface area ($m^2/g$) | 5–8 | 6–8 | 3–5 | 6–8 | 4–6 | 4–7 | 3–5 | 6–8 | 4–5 | 3–5 | 4–5 | 3–5 | 4–6 | 4–6 |
| Polyvinylalcohol on the fibers (% by weight) | 2.1 | 7 | 6.3 | 9 | 8.7 | 7.2 | 6-4 | 3.1 | 5.2 | 0.7 | 0.7 | 2.7 | 2.5 | 2.1 |
| LRo (m.) | 3100 | 5190 | 5090 | 5480 | 5930 | 5040 | 5110 | 3980 | 4030 | 1090 | 1120 | 2410 | 2500 | 1600 |
| $LR_5$ (m.) | 310 | 2330 | 1210 | 2670 | 2220 | 2330 | 1300 | 460 | 945 | 260 | 230 | 565 | 420 | 200 |
| Translucent points in paper (number/$dm^2$) | 130 | 72 | 32 | 50 | 65 | 48 | 52 | 55 | 108 | 1460 | 680 | 69 | 92 | 155 |

Notes to Table 1:
*having an inherent viscosity of 1.7 in N,N—dimethylformamide at 30° C. and at the concentration of 0.5 g/100 cc solution.
**Grade K60 of General Aniline.

EXAMPLES 13–26

These examples are given to show the importance of operating at a volume ratio of the solvent for the olefinic polymer to the solvent for the hydrophylic polymer of at least 2.5, also at different concentration of the hydrophilic polymer. A solution of H.D. polyethylene, having a M.I.=0.3±0.1 g/10′, was used at the concentration of 50 g per 1,000 cc of n.hexane. Polyvinylalcohol (i.e. polyvinylacetate having a 98% hydrolisis

EXAMPLES 27–28

An emulsion was prepared by using a solution containing 50 g of polypropylene (having a M.I.=10 g/10′) in 1000 cc. of n-hexane and a solution of polyvinylalcohol (i.e. a 98% hydrolysed polyvinylacetate) in water. The emulsion was heated to the temperature of 140° C. and extruded under the autogenous pressure by using the same devices and conditions as described in Examples 1–12.

In table 6 there are reported the characteristics of the emulsion and the fibers thus obtained.

TABLE 6

| | | Test | |
|---|---|---|---|
| | | 27 | 28 |
| n.hexane/water volume ratio | | 1 | 2.8 |
| polyvinylalcohol in the water solution | g/l water | 30 | 19.7 |
| Characteristics of the fibers | | | |
| polyvinylalcohol on the fibers | % b.w. | 1.8 | 4.5 |
| average length | m | 2.12 | 2.05 |
| diameter | micron | 8–10 | 6–9 |
| surface area | $m^2/g$ | 3–4 | 4–5 |
| LRo | m. | 1,850 | 3,200 |
| $LR_5$ | m. | 69 | 620 |
| translucent points in paper | $n^o/dm^2$ | 36 | 32 |

EXAMPLE 29

The following example illustrates the preparation of paper endowed with an improved tearing resistance, prepared from mixtures of cellulosic fibers with the two-component fibers obtained according to example No. 8.

50 Kg. of sulphate-treated conifer cellulose, opened and then refined in an Escher-Wiss conical refiner up to 28° SR, were dispersed in water at a concentration of 3 g/l and transformed into paper sheets in a laboratory paper machine.

Following the same procedure, but using a mixture of the abovesaid cellulose with 20% by weight of the fibers of example No. 8, paper sheets were prepared, whose characteristics are compared in Table 7 with those of the paper of cellulose only prepared in advance.

EXAMPLE 30

Preparation of document paper, with a high number of folds, by using two-component fibers prepared according to example No. 7.

25 Kg. of sulphate-treated conifer cellulose in admixture with 25 Kg. of sulphite-treated birch tree cellulose were refined as in example 29 up to 24° SR and transformed into sheets as described in such example.

Following the same procedure, sheets were prepared by using a mixture of said cellulose with 40% by weight of the fibers of example No. 7.

The characteristics of the sheets prepared from cellulose only and of the sheets prepared from cellulose blended with synthetic fibers are shown in Table 8.

EXAMPLE 31

Use of the fibers prepared according to example 8 as binders in asbestos-based papers.

100 Kg. of a mixture of asbestos of the chrysotile type and of asbestos of the crocidolite type in a weight ratio of 80/20 were treated in a mixing mill at 100% of moisture content, for 30 minutes, in order to open the fibers, whereafter they were dispersed in a pulper in 5 $m^3$ of water. The slurry was then used in part to prepare sheets in a paper machine, and in part was additioned with the fibers of example 8, in such amount as to adjust in the slurry an asbestos fibers/synthetic fibers weight ratio equal to 80/20. The slurry so additioned was then used to prepare sheets in the usual manner. The characteristics of the sheets prepared from asbestos only are compared, in Table 9, with the characteristics of the mixed sheets (asbestos/synthetic fibers) so obtained.

EXAMPLE 32

Use of the fibres prepared according to example 8 as cohesion-promoting agents of papers based on rayon fibres.

460 g of rayon fibres, having an average weighed length of 4 mm and a tenacity of 2 g/tex, were suspended in 23 liters of water and the suspension was utilized to prepare sheets by means of a laboratory molding-drying machine.

Following the same modalities, but operating with a mixture of 414 g of said rayon fibres and of 46 g of the fibres of example 8, sheets having the characteristics recorded on Table 10 were prepared in the same manner.

TABLE 7

| | Weight ($g/m^2$) | Thickness ($\mu$) | Density ($g/cm^3$) | Elongation (%) | Bursting resistance ($Kg/cm^2$) | Tearing factor |
|---|---|---|---|---|---|---|
| Paper of cellulose only | 75 | 128 | 0.58 | 2.5 | 3.1 | 95 |
| Mixed paper according to the present example | 75 | 134 | 0.56 | 3.5 | 3.2 | 160 |

TABLE 8

| | Weight | Thickness | Density | Tenacity (Kg/15 mm) | | Elongation at break (%) | | Double folds | | Bursting strength |
|---|---|---|---|---|---|---|---|---|---|---|
| | ($g/m^2$) | ($\mu$) | ($g/cm^3$) | longit. | transv. | longit. | transv. | longit. | transv. | ($Kg/cm^2$) |
| Check paper (cellulose only) | 145 | 155 | 0.935 | 17.5 | 7.3 | 2.5 | 6.5 | 1090 | 510 | 4.2 |
| Mixed paper according to the present example | 143 | 160 | 0.894 | 16.9 | 7.1 | 3.1 | 7.5 | 3000 | 3000 | 4.0 |

TABLE 9

| | Weight ($g/m^2$) | Thickness ($\mu$) | Longitud. tenacity (Kg/15 mm) | Longitud. elongation (%) | Longitud. tearing factor ($m^2$) |
|---|---|---|---|---|---|
| Check sheets (of asbestos only) | 80 | 150 | 0.15 | 3 | not measurable (it breaks immediately) |

TABLE 9-continued

| | Weight ($g/m^2$) | Thickness ($\mu$) | Longitud. tenacity (Kg/15 mm) | Longitud. elongation (%) | Longitud. tearing factor ($m^2$) |
|---|---|---|---|---|---|
| Mixed sheets according to the present example | 81 | 80 | 1.5 | 4 | 35 |

TABLE 10

| | Weight ($g/m^2$) | Longitudinal tenacity (Kg/15 mm) |
|---|---|---|
| Check sheets (of rayon fibers only | 100 | not measurable (it breaks immediately) |
| Mixed sheets according to the present example | 100 | 1.3 |

What we claim is:

1. A process for preparing a two-component fiber having a surface area of at least 1 $m^2/g$ consisting of a core of an olefinic polymer and an outer sheath of a hydrophilic polymer, suited for replacing cellulose fibers in the manufacture of paper and paper-like products, comprising:

extruding a mixture, at autogenous pressure or greater, into a medium at a lower pressure, said mixture being a stable water-in-oil emulsion comprising an olefinic polymer and a solvent, and a hydrophobic polymer and a solvent, said solvents being, in part, reciprocally insoluble, said emulsion being characterized by a volume ratio of the solvent for the olefinic polymer to the solvent for the hydrophilic polymer of at least 2.5, the concentration of the hydrophilic polymer in its own solvent being at least 2 grams per liter of solvent, and the concentration of the olefinic polymer in its solution being between 20 and 200 g/l of solvent, said extruding being conducted at a temperature exceeding the boiling temperature of the solvent for the olefinic polymer, and at a temperature at least equal to the dissolution temperature of the olefinic polymer in said solvent.

2. A process according to claim 1, wherein said volume ratio of the solvent for the olefinic polymer to the solvent for the hydrophilic polymer in said emulsion is between 2.5 and 15.

3. A proces according to claim 2, wherein said volume ratio is between 2.7 and 10.

* * * * *